United States Patent [19]

Jundt et al.

[11] 4,253,442

[45] Mar. 3, 1981

[54] IGNITION SYSTEM WITH IMPROVED TEMPERATURE AND VOLTAGE COMPENSATION

[75] Inventors: Werner Jundt, Ludwigsburg; Bernd Bodig, Leinfelden; Gerd Höhne, Ludwigsburg; Georg Pfaff, Asperg; Gerhard Söhner, Remshalden; Bernd Kalkhof, Reutlingen, all of Fed. Rep. of Germany

[73] Assignee: Robert Bosch GmbH, Stuttgart, Fed. Rep. of Germany

[21] Appl. No.: 60,878

[22] Filed: Jul. 26, 1979

[30] Foreign Application Priority Data

Jul. 29, 1978 [DE] Fed. Rep. of Germany ..... 2833434

[51] Int. Cl.[3] ..... F02P 1/00

[52] U.S. Cl. ..... 123/618; 123/644

[58] Field of Search ..... 123/148 E

[56] References Cited

U.S. PATENT DOCUMENTS

| | | | |
|---|---|---|---|
| 3,892,219 | 7/1975 | Preiser et al. | 123/148 E |
| 3,937,193 | 2/1976 | Kim | 123/148 E X |
| 4,176,645 | 12/1979 | Jundt et al. | 123/148 E |

FOREIGN PATENT DOCUMENTS

| | | | |
|---|---|---|---|
| 2424896 | 12/1975 | Fed. Rep. of Germany . | |
| 2533047 | 2/1977 | Fed. Rep. of Germany | 123/148 E |

*Primary Examiner*—Tony M. Argenbright

*Attorney, Agent, or Firm*—Frishauf, Holtz, Goodman & Woodward

[57] ABSTRACT

The voltage across a capacitor is changed in a first direction while the current in the primary winding of the ignition coil increases to a predetermined value less than the value required for ignition and is thereafter changed in a second direction until ignition takes place. The voltage across the capacitor is applied to the inverting input of a difference amplifier constituting a threshold stage controlling the initiation and termination of current flow through the ignition coil. The two changes are symmetrical when the engine speed remains constant. The residual voltage across the capacitor at the end of the second change is maintained until the start of the next subsequent first change, so that the time at which the threshold stage switches in, that is the time at which primary current starts to flow in the ignition coil changes as a function of the residual voltage in the capacitor.

11 Claims, 2 Drawing Figures

IGNITION SYSTEM WITH IMPROVED TEMPERATURE AND VOLTAGE COMPENSATION

The present invention relates to ignition systems and, in particular, to ignition systems in internal combustion engines wherein excess power consumption takes place at low engine speeds and systems which are subject to undesired variations in their operating characteristics due to variations in supply voltage and/or ambient temperature.

BACKGROUND AND PRIOR ART

German publication DE-OS No. 2,424,896 discloses an ignition system which has the above-mentioned disadvantages. In this system, the primary winding of the ignition coil is connected in series with an ignition switch and the so-formed series combination is connected to the battery of the vehicle. A signal generator is coupled to the crankshaft of the internal combustion engine. A control switch circuit connected to the signal generator is conductive while the crankshaft turns through a first angle of rotation and is blocked while the crankshaft turns through a second angle of rotation immediately following said first angle of rotation. The system further has storage means connected to the control switch means so that the signal stored in the storage means changes in a first direction while the control switch means is conductive and in a second direction while the control switch means is in the blocked state. The storage signal is monitored by threshold means which, when its threshold is reached during the change in the second direction of the storage signal, causes the ignition switch to switch to the conductive state and which maintains this conductive state until the control switch means are switched into the conductive state by the signal from the signal generator.

THE INVENTION

In accordance with the present invention, means are provided for furnishing a monitoring signal indicative of the amplitude of current flowing through the primary winding. Means are further provided for shifting the threshold of the threshold means under control of the monitoring signal. Preferably, the monitoring means are constituted by a resistor connected in series with the primary winding of the ignition coil, while the threshold shifting means comprise a capacitor and control circuit means which control the voltage across the capacitor so that the residual value at the end of one cycle, which constitutes the initial value at the end of the next cycle, changes to compensate for temperature and voltage variations.

DRAWING ILLUSTRATING A PREFERRED EMBODIMENT

Figure 1:
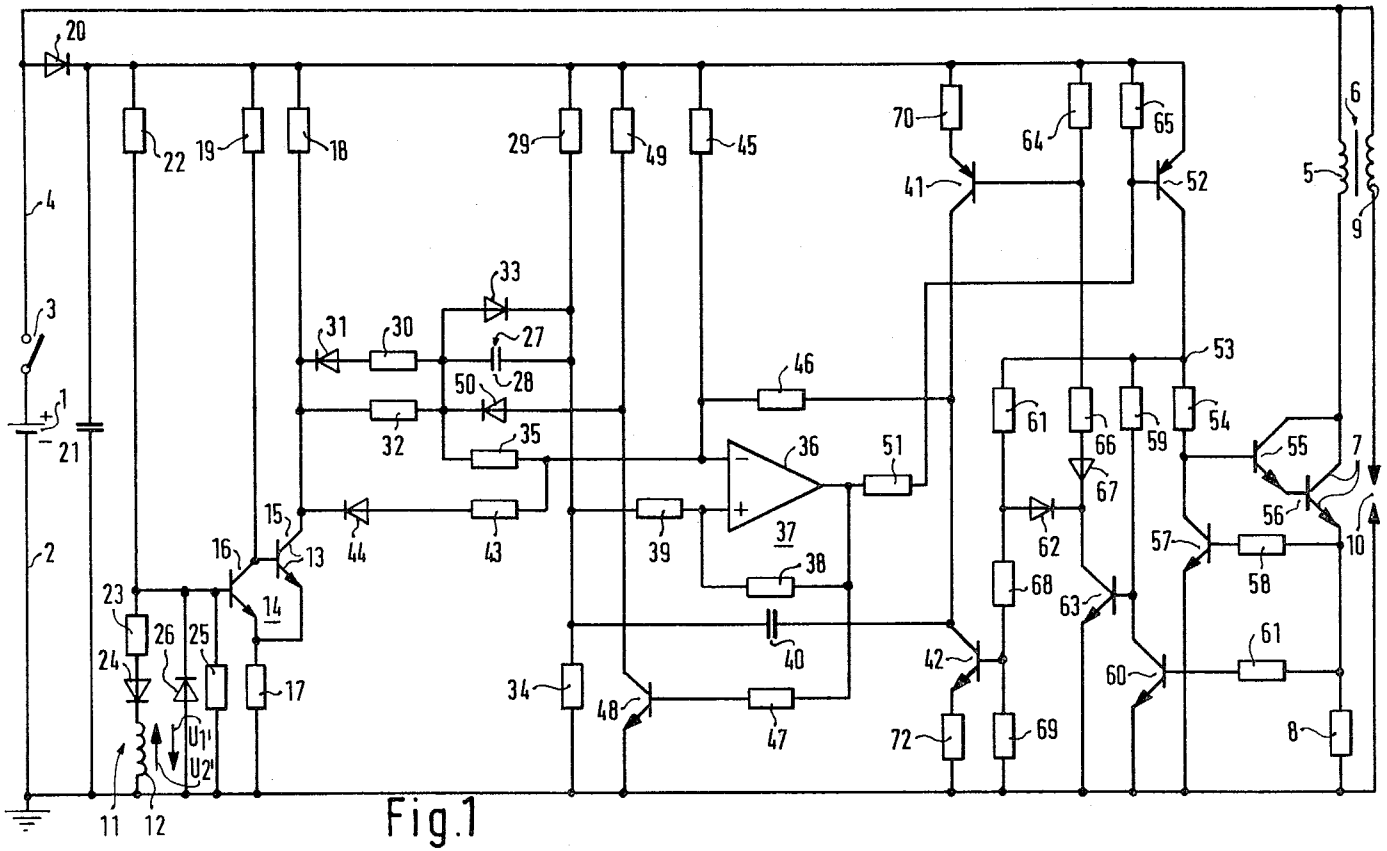

FIG. 1 is a circuit diagram of a preferred embodiment of the present invention; and FIGS. *2a–2f* are voltage-timing diagrams at different points in the circuit of FIG. 1.

The ignition system shown in FIG. 1 is suitable for use in an internal combustion engine which, preferably, is in a motor vehicle. A DC voltage source 1 furnishes the energy for the apparatus, the source preferably being the battery of the motor vehicle. The negative terminal of battery 1 is connected through a line 2 to a reference potential, such as the chassis of the vehicle, while its positive terminal is connected through a switch 3 to the positive supply line 4. The positive supply line 4 is connected to one terminal of the primary winding 5 of an ignition coil 6. The other side of winding 5 is connected through an ignition switch (transistor) 7 and a monitoring resistor 8 to line 2. The secondary winding 9 of ignition coil 6 is also connected to line 2 through the spark plug.

The ignition process is controlled by a signal generator 11 which, in the illustrated example, is constituted by a small AC generator whose winding 12 is shown. The output of signal generator 11 at its winding 12 is a voltage which is shown in FIG. *2a* and has a negative half wave $U_1$ and a positive half wave $U_2$. The output of signal generator 11 is connected to a control switch circuit generally designated by reference numeral 13. Control switch circuit 13 is formed by the emitter-collector circuit of a transistor 15. Transistor 15 is the output transistor of a Schmitt trigger circuit 14 which further comprises an input transistor 16. The collector of transistor 16 is connected to the base of transistor 15, its emitter is connected through a resistor 17 to line 2 and its collector is connected through a resistor 19 to the cathode of a diode 20 whose anode is connected to line 4. The emitters of transistors 15 and 16 are connected in common.

A capacitor 21 is also connected from the cathode of diode 20 to line 2. The cathode of diode 20 is also connected through a resistor 22, a further resistor 23, a diode 24 and winding 12 of signal generator 11 to line 2. The common point of resistors 22 and 23 is connected to the base of transistor 16 and is further connected through the parallel combination of a resistor 25 and a diode 26 to line 2. The emitter-collector circuit of transistor 15 is conductive while a crankshaft driving signal generator 11 turns through a first angle of rotation and is blocked while the crankshaft turns through the second, adjacent angle of rotation.

The ignition system further has a storage 27 which, in the simplest case as shown in the example in FIG. 1, may be a capacitor 28. The storage 27 has a first terminal connected through a resistor 29 and a second terminal connected through a resistor 30, a diode 31 and a resistor 18 to the cathode of diode 20. A further resistor 32 is connected in parallel to the series circuit including resistor 30 and diode 31. A diode 33 is connected in parallel with storage 27, its cathode being connected to resistor 29. Resistor 29 forms a voltage divider with a resistor 34 having one terminal connected to resistor 29 and its second terminal connected to line 2. The value of the resistors is such that the voltage at the common point of resistors 29 and 34 is approximately half of the battery voltage. The voltage at the terminal of storage 27 connected to resistor 30 is shown in FIG. *2c*. The terminal of storage 27 connected to resistor 30 is also connected through a resistor 35 to the inverting input of an operational amplifier 36. Operational amplifier 36 with its associated components constitutes a threshold stage 37. Specifically, the output of operational amplifier 36 is connected through a resistor 38 to its direct input. The direct input of operational amplifier 36 is connected through a resistor 39 to the common point of resistor 29 and 34. A capacitor 40 is associated with threshold stage 37. Transistors 41 and 42 are connected as constant current sources and charge and discharge capacitor 40 which act as an integrator. The voltage across capacitor 40 varies the threshold of threshold stage 37. The voltage variation with respect to time at the output of threshold stage 37 is shown in FIG. 2*f*, while the voltage variation with respect to time at the terminal of capacitor 40 connected to transistors 41, 42 is shown in FIG. 2*e*.

The inverting input of operational amplifier 36 is further connected to the collector of transistor 15 through a series combination of a resistor 43 and a diode 44, to the cathode of diode 20 through a resistor 45 and through a resistor 46 to that terminal of capacitor 40 which is connected to transistors 41, 42. The output of threshold stage 37 is connected through a resistor 47 to the base of a transistor 48 (npn transistor). The emitter of transistor 48 is connected to line 2, while its collector is connected through a resistor 49 to the cathode of diode 20. The collector of transistor 48 is further connected through a diode 50 whose cathode is connected to the common point of resistor 30 and storage 27. Finally the output of threshold stage is connected through a resistor 51 to the base of an (pnp) transistor 52. The emitter of transistor 52 is connected to the cathode of diode 20 while its collector is connected to a terminal 53. Terminal 53 is connected through a resistor 54 to the base of an (npn) transistor 55. The emitter-collector circuit of transistor 55 is connected in a Darlington circuit configuration with transistor 56 whose emitter-collector circuit forms the ignition switch 7. Specifically, the collector of transistor 55 is connected to the collector of transistor 56 while its emitter is connected to the base of transistor 56. The base of transistor 55 is further connected to the collector of an (npn) transistor 57. The emitter of transistor 57 is connected to line 2 while its collector is connected through a resistor 54 to terminal 53. The base of transistor 57 is connected through a resistor 58 to the emitter of transistor 56. Terminal 53 is further connected to the collector of an (npn) transistor 60 through a resistor 59. The emitter of transistor 60 is connected to line 2 while its base is connected through a resistor 61 to the emitter of transistor 56. Finally, terminal 53 is connected through a resistor 61 to the anode of a blocking diode 62 whose cathode is connected to the collector of a (npn) transistor 63. The emitter of transistor 63 is connected to line 2 while its base is connected to the collector of transistor 60. The base of transistor 41 is connected through a resistor 64 to the cathode of diode 20. The base of transistor 41 is further connected through a resistor 66 to the anode of a blocking diode 67 whose cathode is connected to the collector of transistor 63. The anode of diode 62 is connected through a series circuit including resistors 68 and 69 to line 2, the common point of resistors 68, 69 being connected to the base of transistor 42. The emitter of transistor 41 is connected through a resistor 70 to the cathode of diode 20, while that of transistor 42 is connected through a resistor 72 to line 2.

The variation of current with respect to time in primary winding 5 of ignition coil 6 is shown in FIG. 2*d*.

OPERATION

Figure 2:
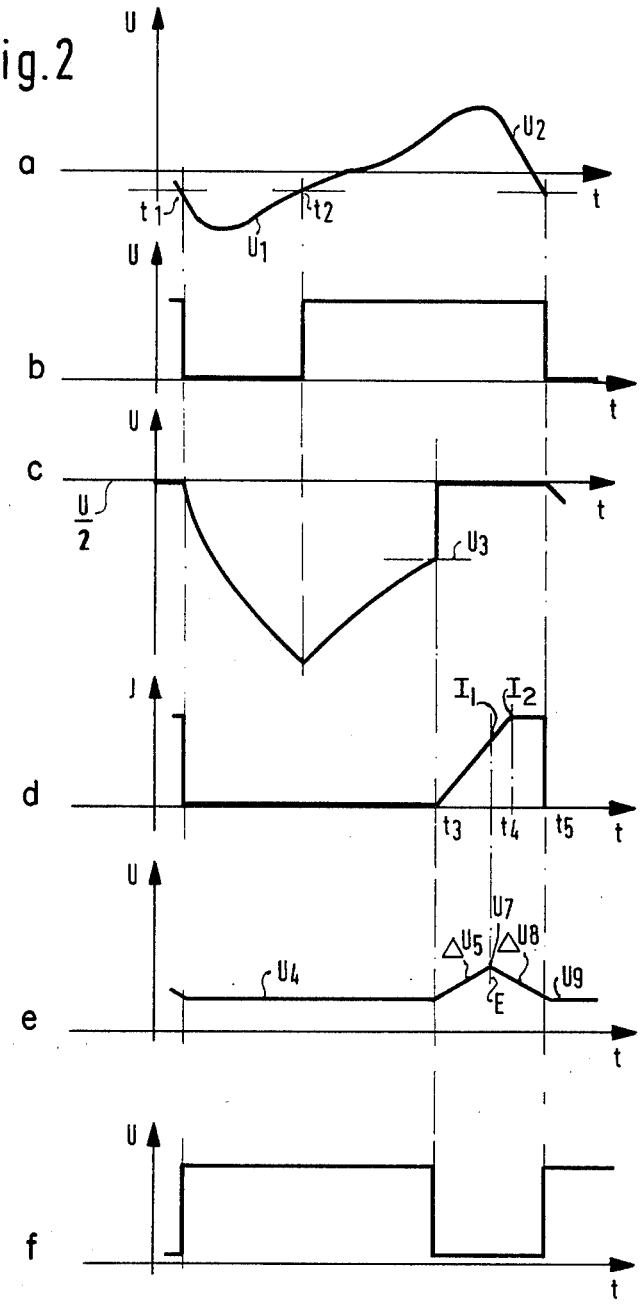

The circuit is ready for operation upon closing of switch 3. Its functioning will be discussed starting at time $t_1$ (FIG. 2). At this time the negative half wave $U_1$ appears across winding 12 of signal generator 11. The corresponding voltage $U_{1'}$ (FIG. 1) causes a current to flow through components 25, 26, 23 and 24 which causes the bias at the base of transistor 16 to be decreased to such an extent that its emitter-collector circuit becomes blocked at time $t_1$. This causes the emitter-collector circuit of transistor 15 to become conductive so that its collector is at substantially reference potential at time $t_1$ (FIG. 2*b*).

A first change of charge then starts across storage 27 (FIG. 2*c*). This first change of charge is a discharge of capacitor 28 through circuit components 30–32, 13, 17, and 29 and 20. The discharge continues as long as the crankshaft driving signal generator 11 turns through a first angle of rotation. Simultaneously, at time $t_1$ the transition of the control switch circuit 13 (emitter-collector circuit of transistor 15) into the conductive state causes the voltage at the inverting input of operational amplifier 36 to be such that the threshold stage switches off, that is its output becomes a positive potential. This causes the emitter-collector circuit of transistor 52, the emitter-collector circuit of transistor 55 as well as the emitter-collector circuit of transistor 56 (herein referred to as ignition switch 7) to switch into the blocked state. The current flowing through primary winding 5 is interrupted and a high voltage pulse is introduced in the secondary winding of the ignition coil which causes a spark to be generated at spark plug 10.

The conductive state of control switch circuit 13 is maintained while the crankshaft of the internal combustion engine turns through a first angle of rotation. This is terminated at time $t_2$ (FIG. 2). At this point the voltage $U_{1'}$ (FIG. 1) is no longer sufficient to keep the emitter-collector circuit of transistor 16 in the blocked state. This emitter-collector circuit therefore becomes conductive while that of output transistor 15 becomes blocked. The second change of charge across storage 27 is initiated. This is a charging of capacitor 27 through the circuit including elements 20, 18, 32 and 34 (FIG. 2*c*). If, during this change of charge across capacitor 28 the threshold $U_3$ (FIG. 2*c*) of threshold stage 37 is reached, a threshold output signal is furnished, that is the output of stage 36 is switched to a negative potential. This causes the emitter-collector circuit of transistor 52, the emitter-collector circuit of transistor 55 and the emitter-collector circuit of transistor 56 to become conductive. Thus, current starts to flow through primary winding 5 of ignition coil switch 6 at time $t_3$ (FIG. 2*d*) and energy for the next ignition process is stored. Since the emitter-collector circuit of transistor 52 has become conductive, the emitter-collector circuit of transistor 63 also becomes conductive which in turn causes the emitter-collector circuit of transistor 42 to be maintained in the blocked state while the emitter-collector circuit of transistor 41 becomes conductive. The voltage across capacitor 40 changes from a value $U_4$ at this point, that is the change $\Delta U_5$ (FIG. 2*e*) commences. The change stops as soon as the current through the primary winding has reached the value $I_1$ (FIG. 2*d*). At this point, the voltage across resistor 8 reaches a value which causes the emitter-collector circuit of transistor 60 to become conductive. The emitter-collector circuit of transistor 63 therefore becomes blocked, causing the emitter-collector circuit of transistor 41 to become blocked. The base-emitter circuit of transistor 42 therefore receives current through the emitter-collector circuit of transistor 52, so that its emitter-collector circuit becomes conductive. This causes a second change $\Delta U_8$ to be initiated across capacitor 40, the change of course starting at the then-present integration or voltage value $U_7$. This second change $\Delta U_8$ terminates at the next ignition time, that is when threshold switch 37 again becomes switched off. The integration value $U_9$ then present across integrator 40 remains substantially constant until the next change $\Delta U_5$ occurs.

Transistor 57 acts as a current limiting transistor, that is it prevents any further increases in the current through the primary winding 5 after the value required for successful ignition, $I_2$, has been reached. After the value $I_2$ has been reached, the voltage across resistor 8 is sufficient to cause the emitter-collector circuit of transistor 57 to become somewhat conductive and thereby cause the current through the emitter-collector circuit of transistor 56 to be limited. The current is to be limited in such a way that while the engine is starting up the current in primary winding 5 after reaching the value $I_2$, remains at this amplitude for a time $t_4$ to $t_5$ (FIG. 2*d*). This allows sufficient energy to be stored in the ignition coil even if, because of acceleration of the engine, the time during which current flows in the primary winding is shortened.

When the speed of the engine remains constant, the changes $\Delta U_5$ and $\Delta U_8$ are symmetrical relative to a perpendicular drawn through the value $U_7$ existing at the end of change $\Delta U_5$ and at the beginning of change $\Delta U_8$. The time for changing from the first change $\Delta U_5$ to the second change $\Delta U_8$ is determined by the current in the primary winding, that is takes place when the current in the primary winding reaches the value $I_1$ (FIG. 2*d*).

When, during the second change of charge across storage 27 the threshold value $U_3$ (FIG. 2*c*) is reached at threshold stage 37, then the negative potential at the output of the threshold stage causes the emitter-collector circuit of transistor 48 to be switched to the blocked state. This causes capacitor 28 which constitutes storage 27 to be charged through circuit elements 49, 50 to the value which will constitute the initial value for the next charge change, that is the initial value for the discharge of capacitor 28. Diode 33 causes a defined initial value of charge to be present across capacitor 28 at the start of the charging process, that is at the start of the second charge change.

The voltage across capacitor 40 allows the same amount of ignition energy to be available independent of variations in supply voltage and independent of the conductivity values of the various circuit elements, in particular of the ignition coil 6. The latter can vary to great extents as a function of temperature variations.

If, for example, the supply voltage decreases, the integration value across capacitor 40 and applied to the inverting input of threshold stage 36 through a resistor 46 changes the voltage at the inverting input in such a way that the threshold voltage of threshold stage 37 for the second change in charge takes place at an earlier time, that is in the chosen example at a lower value of voltage across capacitor 28.

In the chosen example, the storage is a capacitor which constitutes the simplest embodiment of the invention. It is, of course, equally possible that storage 27 comprise an integrator, that is an operational amplifier and a capacitor connected thereto. Such combinations are well known. Similarly, storage 27 may be a capacitor which is charged and discharged by constant current sources, that is transistors connected as such as is illustrated for capacitor 40 in conjunction with transistors 41 and 42.

In the illustrated example, the ignition system is shown as having one spark plug only. The invention is, of course, equally applicable to ignition systems in which the high voltage pulses are distributed by means of a known distributor in a predetermined sequence to a plurality of spark plugs.

The AC generator illustrated as one embodiment of signal generator 11 can, of course, be replaced by many other known signal generators. For example, Hall generators, optical-electrical generators or simple interrupter switches can be used, specifically, to replace the emitter-collector circuit of transistor 16 in FIG. 1.

Various changes and modifications may be made within the scope of the inventive concepts.

We claim:

1. In an ignition system for an internal combustion engine having a rotating shaft, said ignition system having an ignition coil (6) having a primary winding (5), ignition switch means (7) connected in series with said primary winding, signal generator means (11) operatively associated with said shaft of said engine for furnishing a position signal indicative of the rotary position of said shaft relative to a reference position, control switch means (13) connected to said signal generator means and having a conductive state while said position signal is indicative of rotation of said shaft through a first angle of rotation and a blocked state while said position signal is indicative of rotation of said shaft through a second angle of rotation immediately following said first angle of rotation, storage means connected to said control switch means so that the storage signal stored in said storage means changes in a first direction while said control switch means is in said conductive state and in a second direction at a predetermined rate while said control switch means is in said blocked state, threshold means (37) connected to said storage means for furnishing a threshold output signal adapted to switch said ignition switch to the conductive state when the threshold of said threshold means is reached by said storage signal during said change in said second direction and for maintaining said ignition switch means in said conductive state until said control switch means is switched back to said conductive state: p1 apparatus for maintaining the energy stored in said ignition coil substantially independent of variations of predetermined operating parameters of said system, comprising means (8) for furnishing a monitoring signal indicative of the current flowing through said primary winding;

means (40) connected to said monitoring signal furnishing means and said threshold means for shifting the threshold of said threshold means under control of said monitoring signal; and storage charge control means (48, 49, 50) connected to said threshold means for substantially increasing said predetermined rate in response to said threshold output signal.

2. A system as set forth in claim 1, wherein a first predetermined current amplitude ($I_2$) is required for sufficient energy storage in said ignition coil;

and wherein said monitoring signal furnishing means furnishes a monitoring signal when said current through said primary winding has a second predetermined amplitude ($I_1$) less than said first predetermined current amplitude.

3. A system as set forth in claim 2, wherein said threshold shifting means comprises means for applying a regulating voltage to said threshold means.

4. A system as set forth in claim 3, wherein said regulating voltage applying means comprises an integrator, the voltage across said integrator constituting said regulating voltage.

5. A system as set forth in claim 4, wherein said integrator comprises a capacitor.

6. A system as set forth in claim 4, wherein said means for applying said regulating voltage to said threshold means further comprises control circuit means for changing the voltage across said integrator means in a first direction when said threshold means switches in, for terminating said change in said first direction and initiating said change in said second direction when said primary current is equal to said second predetermined primary current and for terminating said change in said second direction when said threshold means switches out, thereby creating a residual voltage across said integrator means.

7. A system as set forth in claim 6, wherein said regulating voltage applying means further comprises means for maintaining said residual voltage across said integrator means until the next subsequent switch-in of said threshold means.

8. A system as set forth in claim 1, wherein said storage means comprises a capacitor (27), the voltage across said capacitor constituting said storage signal;

further comprising means (18, 30, 32, 34) for charging said capacitor in said second direction;

and wherein said storage charge control means comprises additional resistance means (49), and controllable switching means (48, 50) for connecting said additional resistance means in parallel with at least part of said charging means in response to said threshold output signal.

9. A system as set forth in claim 8, wherein said controllable switching means comprises a transistor.

10. A system as set forth in claim 1, further comprising means (33) connected in parallel with said storage means for creating a defined initial value of said storage signal at the start of said change in said first direction.

11. A system as set forth in claim 10 wherein said means for creating a defined initial value of said storage signal comprises a diode (33).

* * * * *